US006568983B1

(12) United States Patent
Peters

(10) Patent No.: US 6,568,983 B1
(45) Date of Patent: May 27, 2003

(54) VIDEO ENHANCED GUIDED TOY VEHICLES

(75) Inventor: Geoffrey W. Peters, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 434 days.

(21) Appl. No.: 09/596,975

(22) Filed: Jun. 20, 2000

(51) Int. Cl.[7] ..... A63H 30/00; A63H 18/00; A63H 30/04; A63G 1/100

(52) U.S. Cl. ..... 446/175; 446/444; 446/456; 104/84

(58) Field of Search ..... 446/444, 446, 446/447, 397, 408, 409, 410, 484, 456, 436; 104/84; 901/1

(56) References Cited

U.S. PATENT DOCUMENTS 4,214,266 A * 7/1980 Myers ..... 348/140
4,277,804 A * 7/1981 Robison ..... 348/148
4,636,137 A * 1/1987 Lemelson ..... 414/730
4,654,659 A * 3/1987 Kubo ..... 446/454
4,673,371 A * 6/1987 Furukawa ..... 446/175
4,697,812 A * 10/1987 Rudell et al. ..... 446/446
4,709,265 A * 11/1987 Silverman et al. ..... 348/158
4,795,154 A * 1/1989 Lahr ..... 446/446
4,993,912 A * 2/1991 King et al. ..... 414/729
5,021,878 A * 6/1991 Lang ..... 348/61
5,075,515 A * 12/1991 Yoneda et al. ..... 446/446
5,350,033 A * 9/1994 Kraft ..... 180/167
5,601,490 A * 2/1997 Nakagawa et al. ..... 446/446
5,669,821 A * 9/1997 Prather et al. ..... 472/59
6,079,982 A * 6/2000 Meader ..... 434/29

* cited by examiner

*Primary Examiner*—Jacob K. Ackun
*Assistant Examiner*—Faye Francis
(74) *Attorney, Agent, or Firm*—Trop, Pruner & Hu, P.C.

(57) ABSTRACT

A guided toy vehicle may be operated with an onboard video camera. The video from the video camera may be transmitted to a control station for display by the user. In some embodiments of the present invention, the video may be transmitted from the vehicle to the control station over the same track that guides the vehicle.

17 Claims, 9 Drawing Sheets

VIDEO ENHANCED GUIDED TOY VEHICLES

BACKGROUND

This invention relates generally to toy vehicles, such as track-based toy cars and toy trains.

Toy vehicles may be propelled along a track that acts as a guide to cause the vehicles to traverse a desired course. In addition, the vehicles may receive power through contacts in the track. The operator, from a remote location, can control the speed of the vehicles by adjusting the power supplied to each vehicle.

While this user model has been extremely popular for generations, it has also been relatively unchanged over a large number of years. Thus, it would be desirable to enhance the capabilities of guided toy vehicles.

DETAILED DESCRIPTION

Figure 1:
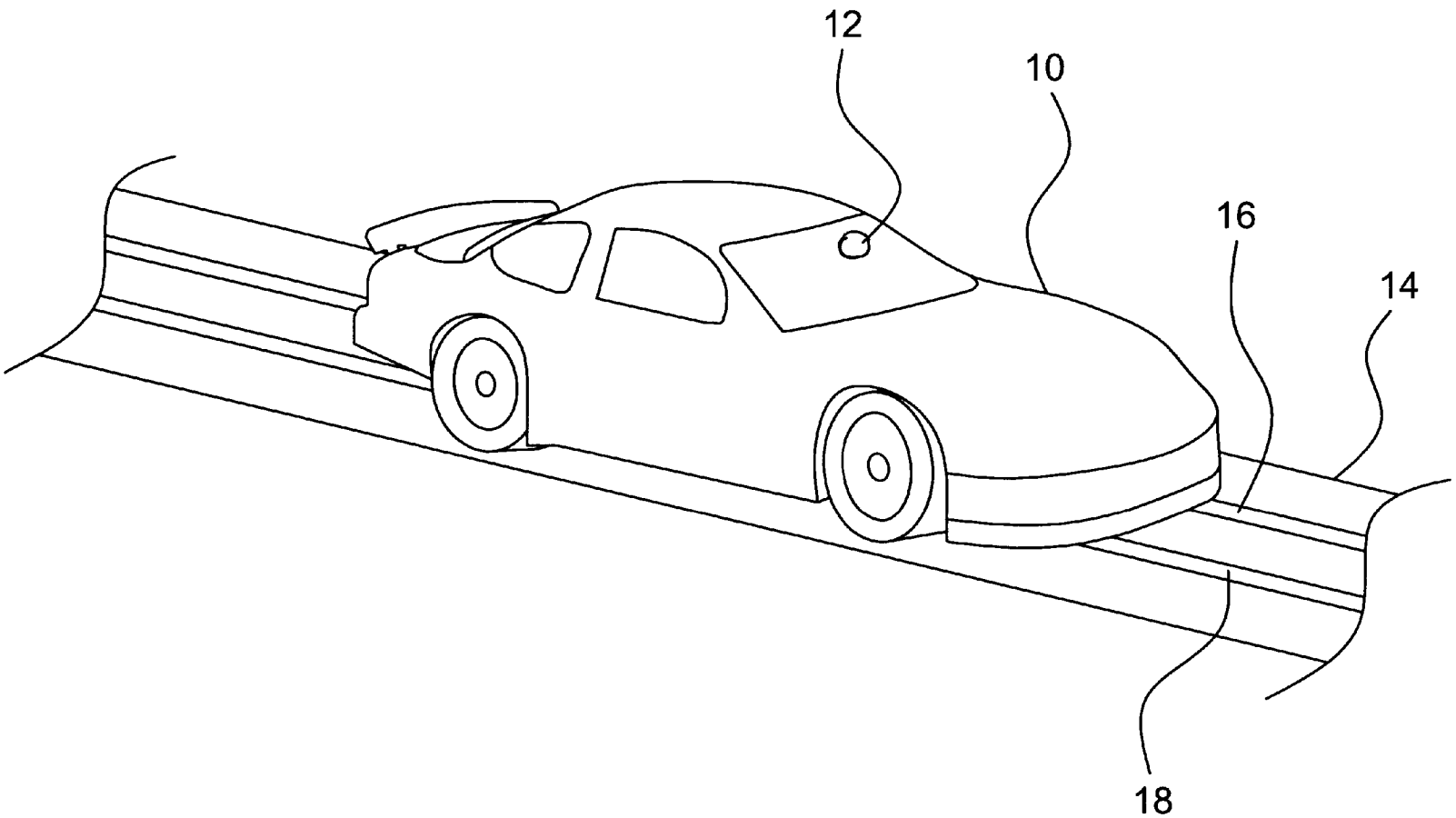
FIG. 1 is an enlarged, partial, perspective view of one embodiment of the present invention.

Referring to FIG. 1, a toy vehicle 10, illustrated in the form of a toy car, may progress along a track 14. The vehicle 10 may have an onboard video camera 12. The track 14 may include a pair of conductors 16 and 18 that respectively provide power to and receive video signals from the vehicle 10 and its camera 12.

The toy vehicle 10 is referred to herein as a "guided vehicle" because its forward progress is guided. That is, the vehicle 10 is either guided by mechanical features on a track 14, or is otherwise guided by another characteristic of the track, such as its color, or the signals it emits. Alternatively, the vehicle 10 may be guided by a lead vehicle. For example, the lead vehicle may have a target that the video camera 12 can track so that the following vehicle is guided by the lead vehicle, even though no mechanical restraint guides the following vehicle.

Figure 2:
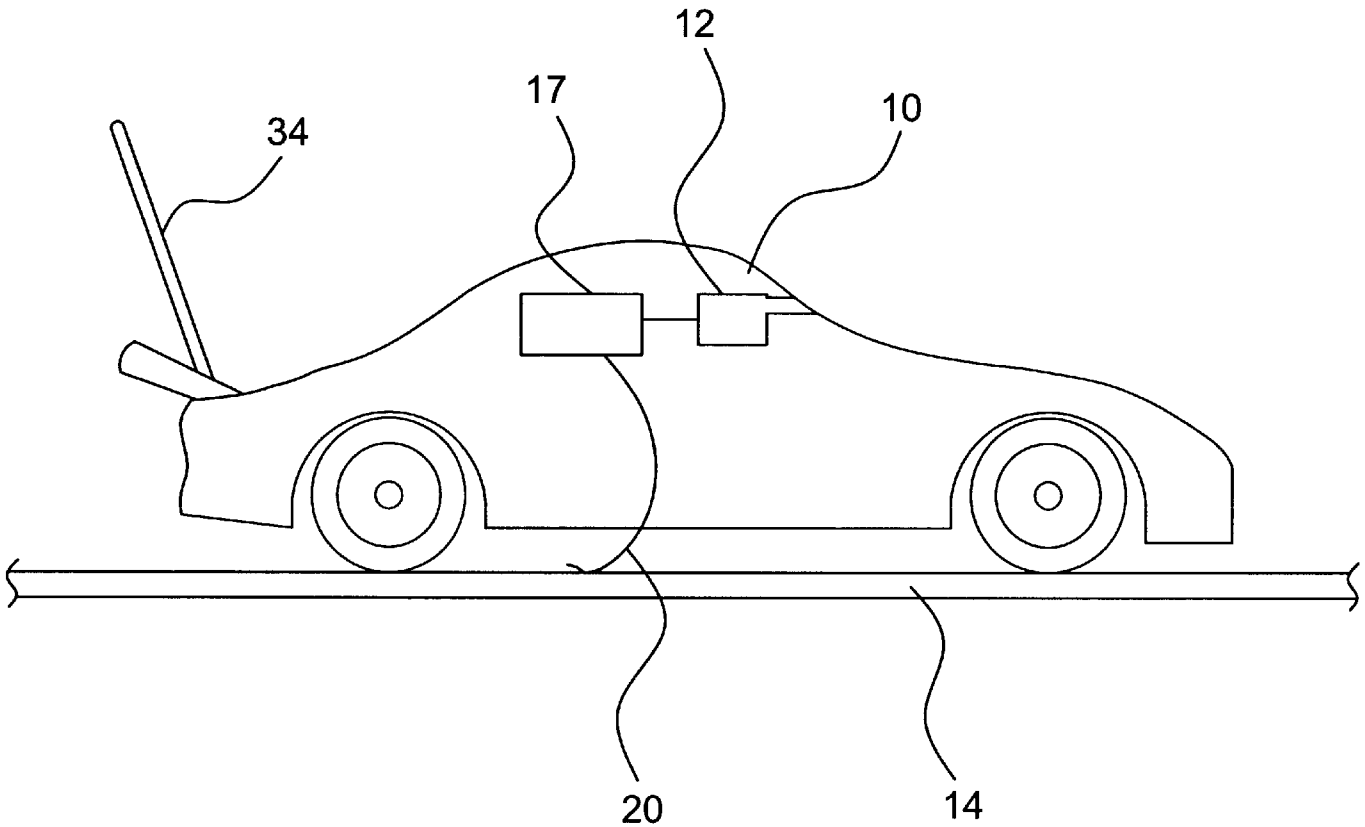
FIG. 2 is an enlarged, partial, cross-sectional view of one embodiment of the present invention.

Turning next to FIG. 2, the vehicle 10 includes a video camera 12 coupled to a frame buffer 17 that stores the captured video frames before transmission over an electrical link 20. The electrical link 20 may be a spring contact, in one embodiment of the present invention. The link 20 may maintain, through spring force, contact with the track 14 and particularly with the conductor 18. Thus, video signals captured by the video camera 12 may be temporarily stored in the frame buffer 17 before transmission to the track 14.

If the track 14 fails to maintain contact with the link 20, the frames may be retransmitted. Alternatively, frames may only be transmitted when good contact is had between the link 20 and the track 14. Thus, the frame buffer 17 insures that video is not lost if the link 20 leaves the track 14 or bounces with respect to the track 14.

Figure 3:
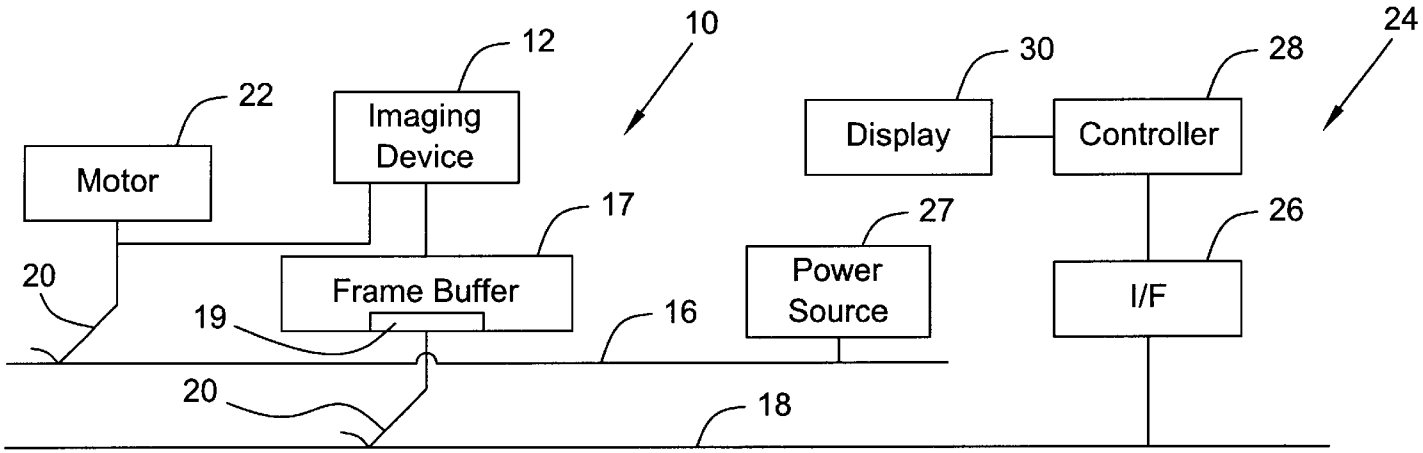
FIG. 3 is a block depiction of one embodiment of the present invention.

In one embodiment of the present invention shown in FIG. 3, a detector 19 included in the frame buffer 17 detects when the link 20 is no longer coupled with the track 14. This may be accomplished, as one example, by monitoring the spring force of the link 20. In another embodiment of the present invention, each frame may be sent repeatedly and if both frames are received, the duplicate frame is discarded.

In some embodiments of the present invention, the progress of the toy vehicle 10 on the track 14 may be controlled by signals provided through the track 14. Thus, depending on the potentials applied through the track 14, the speed of the vehicle 10 may be adjusted. In another embodiment of the present invention, the vehicle 10 may be controlled by radio frequency signals received through an antenna 34.

The power source for the toy vehicle 10 may be the track 14 or an onboard battery, as two examples. In addition, a mechanical propulsion system, such as a friction accelerator, may be utilized to propel the vehicle 10.

Referring to FIG. 3, in one embodiment of the present invention, the video camera 12 is coupled through the frame buffer 17 and the contact 20 to the conductor 18. A separate electrical motor 22 may couple to a separate conductor 16 through the link 20. The video transmitted from the video camera 12 through the frame buffer 17 and the link 20 to the conductor 18 may be received through an interface 26.

The received video may be buffered and provided to a controller 28 at a control station 24. The controller 28 may be a microcontroller or other processor-based device. The video is then rendered and displayed on a video display device 30. The video display device 30 may be a liquid crystal display, or a computer monitor, as two examples.

In some embodiments of the present invention, power may be supplied through a power source 27 to the conductor 16. That power may also be provided to the video camera 12. A single conductor 16 or 18 may also provide power to the vehicle 10 and receive the video from the vehicle 10.

Figure 4:
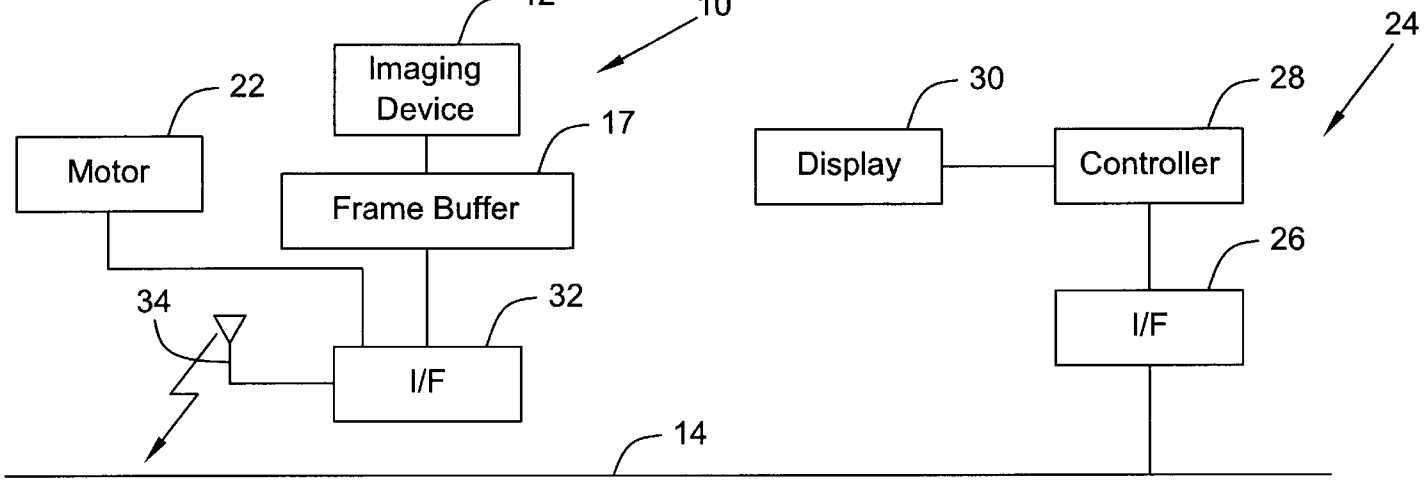
FIG. 4 is a block depiction of another embodiment of the present invention.

In accordance with another embodiment of the present invention, instead of providing the video signals over a physical link 20, an electrical link 20 in the form of an airwave signal may be utilized to transmit the video information. In one embodiment, shown in FIG. 4, the video information is transmitted from an interface 32 and its antenna 34 to the track 14. Namely, the track 14 may include a receiving antenna in the form of a wire embedded in the track. Thus, the transmitter on the toy vehicle 10 need not be very powerful in some embodiments. In such case, the toy motor 22 may be supplied with power from an onboard source (not shown), such as a battery source, as one example.

Figure 5:
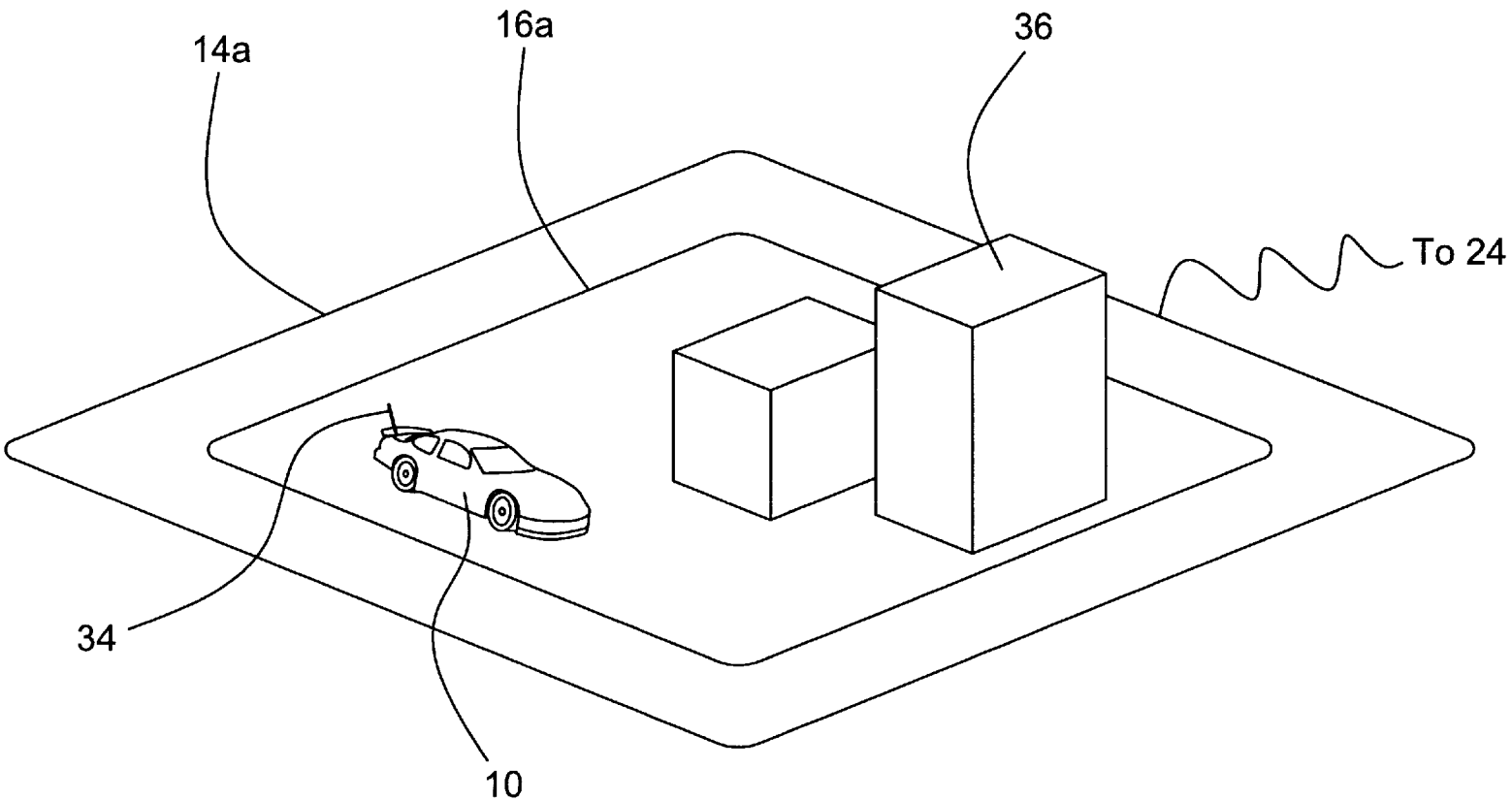
FIG. 5 is a perspective view of another embodiment of the present invention.

In accordance with yet another embodiment of the present invention, the toy vehicle 10 may include an antenna 34 that interacts with an antenna 16*a* and the track 14*a* as shown in FIG. 5. The antenna 16*a* may be embedded in the track 14*a*. The vehicle 10 then may follow a course along the antenna 16*a*, but is not strictly controlled thereby. The vehicle 10 may include the camera 12 as described above. A variety of structures 36 may be included on the track 14*a*, including simulated buildings, people, and other vehicles. The structures 36 may be imaged by the video camera 12 to give a realistic effect.

In some embodiments of the present invention, the track 14*a* may be a flat rollout mat. A flexible antenna 16*a*, stitched within the mat, picks up the broadcasted video from the toy vehicle 12. The throttle of the car and the steering of the car may be remotely controlled. The user may then create his or her own race track, complete with obstacles and jumps. Alternatively, the user may design several city blocks and the toy vehicle 10 may be made to maneuver around those obstacles. Buildings may provide more visual realism interest when seen through the video camera 12 in a relatively small toy vehicle 10.

Figure 6:
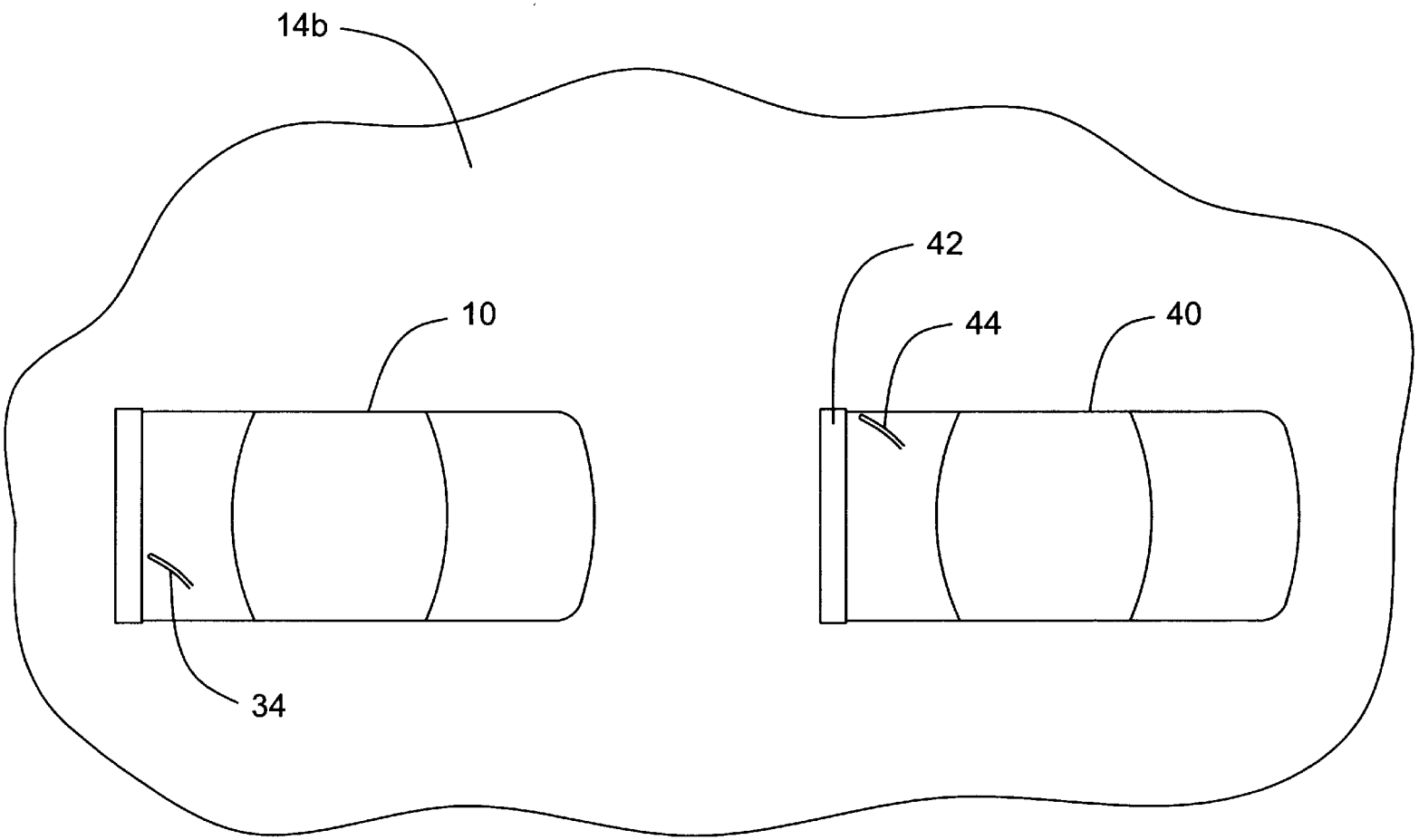
FIG. 6 is a partial, top plan view of still another embodiment of the present invention.

Referring next to FIG. 6, the toy vehicle 10 may follow another toy vehicle 40. In one embodiment, the toy vehicle 40 may include a visual target 42. The target 42 may have a particular graphical design or may be of a particular color. The video camera 12 in the toy vehicle 10 attempts to follow that target 42. In other words, forward progress of the vehicle 10 may be controlled from the controller 28 based on the presence of the target image in the video received from the toy vehicle 10. In one embodiment of the present invention, both the vehicles 40 and 10 may be controlled by airwave signals through antennas 34 and 44. The vehicles 10 and 40 may progress over a track 14*b*.

Thus, the user may control the lead vehicle 40 and the trailing vehicle 10, equipped with the video camera 12, may follow the lead vehicle 40. Direction control signals may be provided through the antenna 44 to the lead vehicle 40.

Figure 7:
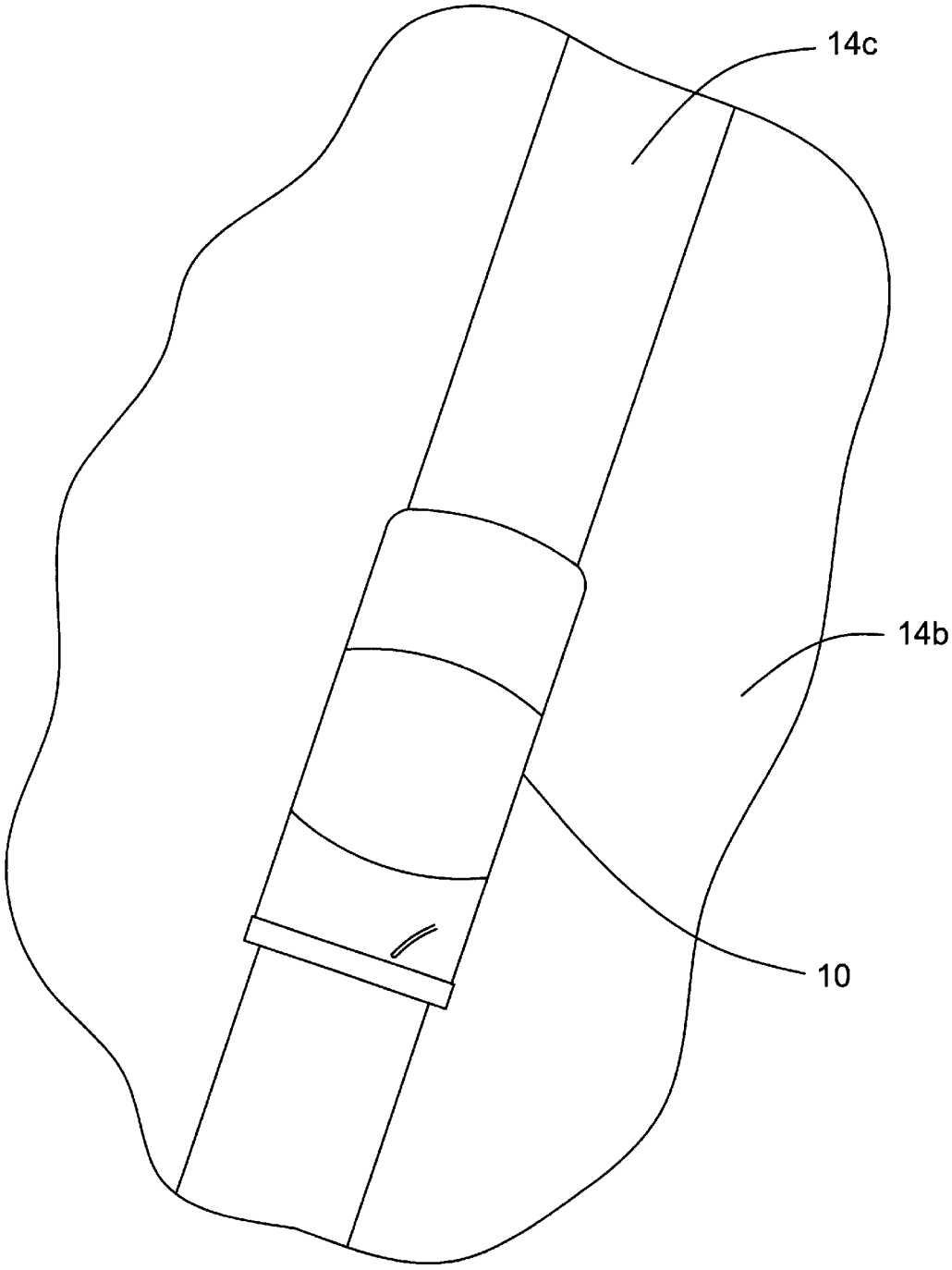
FIG. 7 is a partial, top plan view of still another embodiment of the present invention.

As yet another example, the vehicle 10 may be equipped with the video camera 12 and may follow a pattern 14*c* formed on a mat or other surface 14*b* as shown in FIG. 7. In one embodiment of the present invention, the pattern 14*c* may be a specific color that is recognized by the camera 12 or a coupled processor-based system. The camera 12 may then cause the vehicle 10 to continue to progress in a direction of the color pattern 14*c*. The control of the vehicle 10 may be implemented by the user, physically or automatically, using software operating on the control station 24.

For example, as long as the screen is filled with the particular color represented by the pattern 14*b*, the vehicle 10 progresses straightforwardly. The vehicle 10 turns in one direction or the other to keep the pattern 14*b* in full view. Alternatively, a user watching the display 30 may provide the same control.

In some embodiments of the present invention, the video generated by the vehicle 10 may be utilized to control a characteristic of the vehicle such as its direction or speed of travel. The video may also be utilized to change the orientation of the imaging device 12 as still another example. The video information may also be analyzed to locate areas of higher or lower ambient luminance, relative motion to the vehicle, such as motion towards or away from the particular vehicle, periodicity such as a blinking light, the vehicle's spatial location with the respect to another object, or texture or pattern. Detection of such characteristics may be used to control the vehicle 10. For example, a pattern such as a barcode or an image object may have a particular aspect ratio which may be analyzed to detect the orientation of that object with respect to the vehicle 10.

Figure 8A:
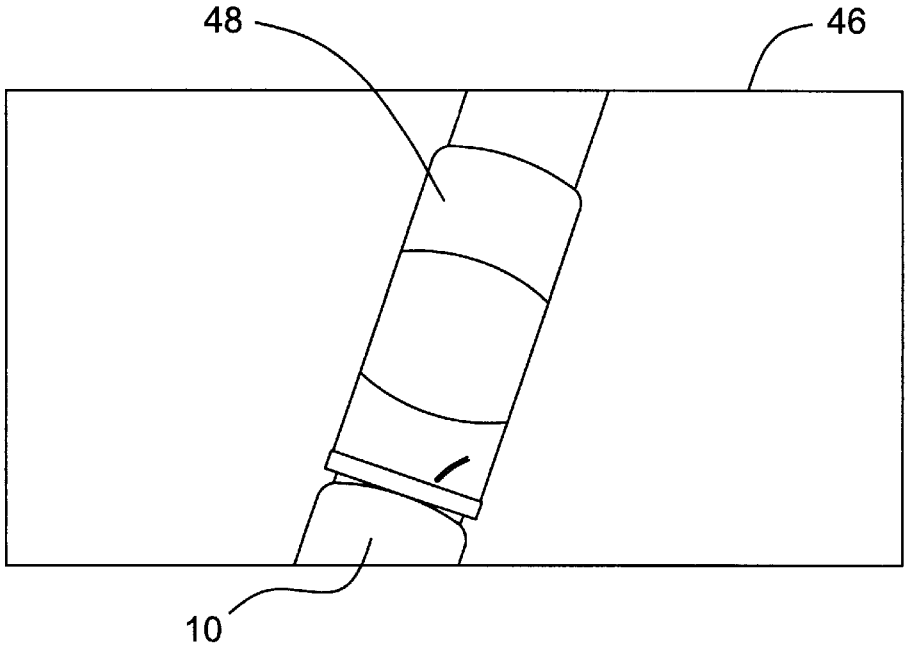
FIG. 8*a* shows a frame captured from a first vehicle after a collision with a second vehicle.
Figure 8B:
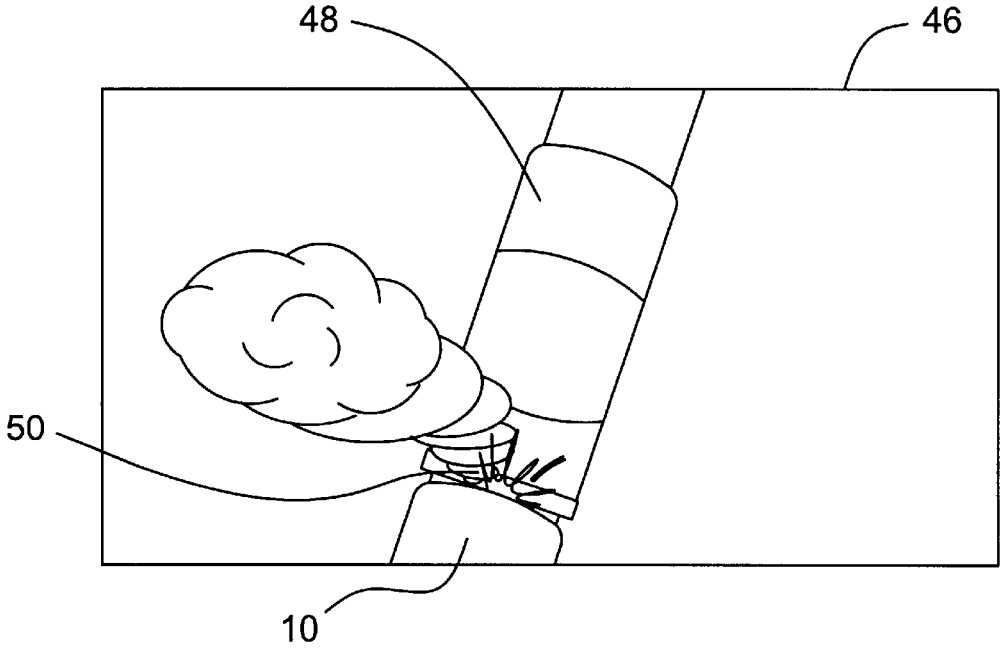
FIG. 8*b* shows a video augmented view of the scene shown in FIG. 8*a;*

In accordance with still another embodiment of the present invention, the video information obtained from the vehicle 10, as shown in FIG. 8*a*, may be augmented to enhance the user's play, as shown in FIG. 8*b*. For example, in the situation where the toy vehicle 10 collides into another vehicle 48, the video taken by the vehicle 10 of the collision (FIG. 8*a*) may be enhanced at a processor-based control station 24 to show on the display 30, added visual effects such as smoke or flames 50 as shown in FIG. 8*b*. Those augmented visual effects may be incorporated over the video of the second vehicle 48 taken by the vehicle 10.

Figure 9A:
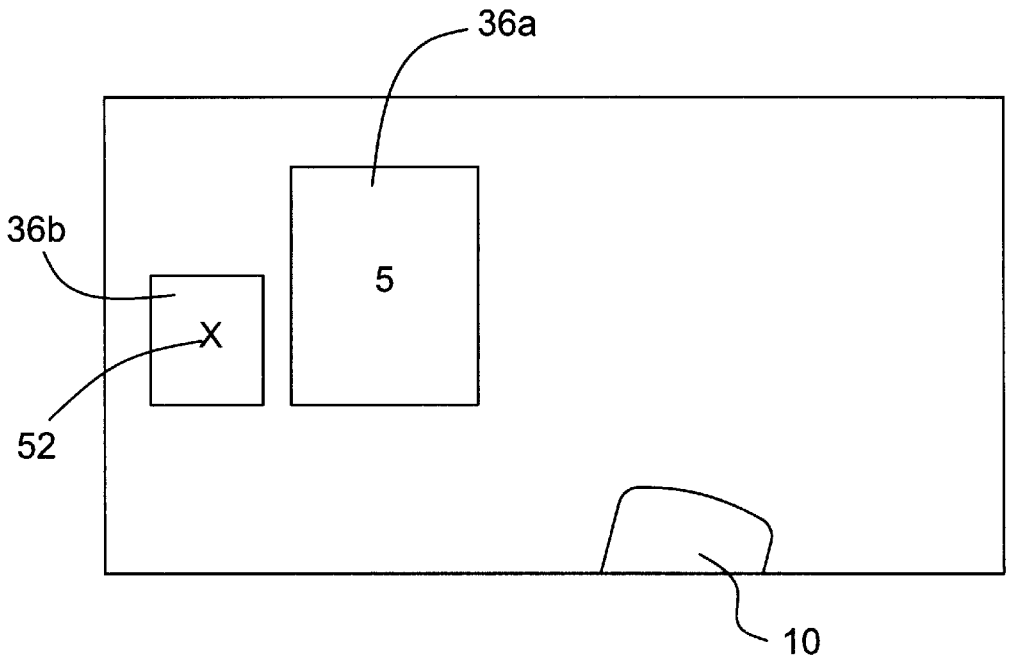
FIG. 9*a* shows a frame captured by an imaging device in a first vehicle.
Figure 9B:
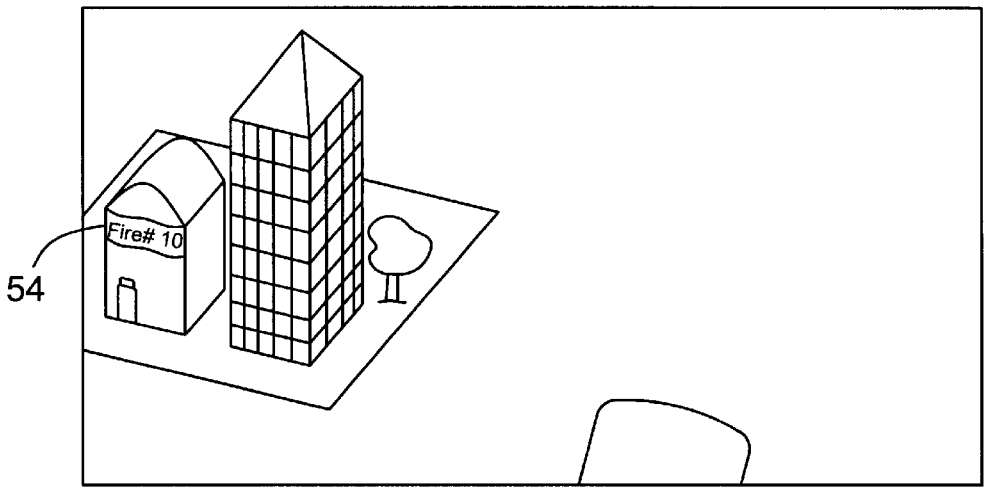
FIG. 9*b* shows an augmented video frame produced from the frame shown in FIG. 9*a;*

As another example of video augmentation, for example in connection with the embodiment shown in FIG. 5, the various structures 36 may include an indicia 52 which may recognized by a controller 28 as indicated in FIG. 9*a*. The controller 28 may then automatically insert more realistic images 54, as shown in FIG. 9*b*, for the relatively simple images of the structures 36 for viewing on the display 30.

Figure 10A:
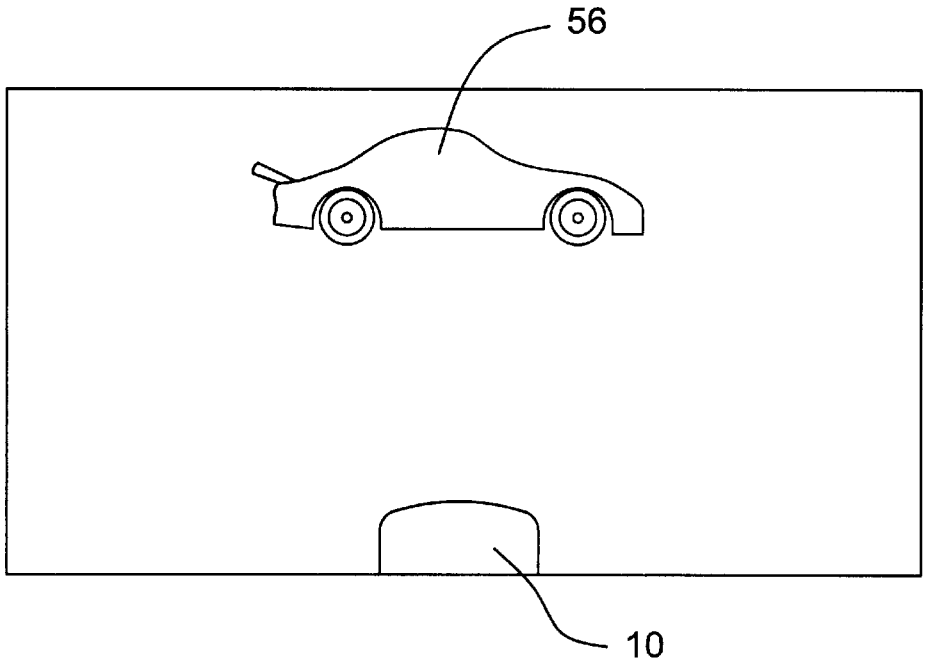
FIG. 10*a* is a video frame shot by an onboard camera in a first vehicle.
Figure 10B:
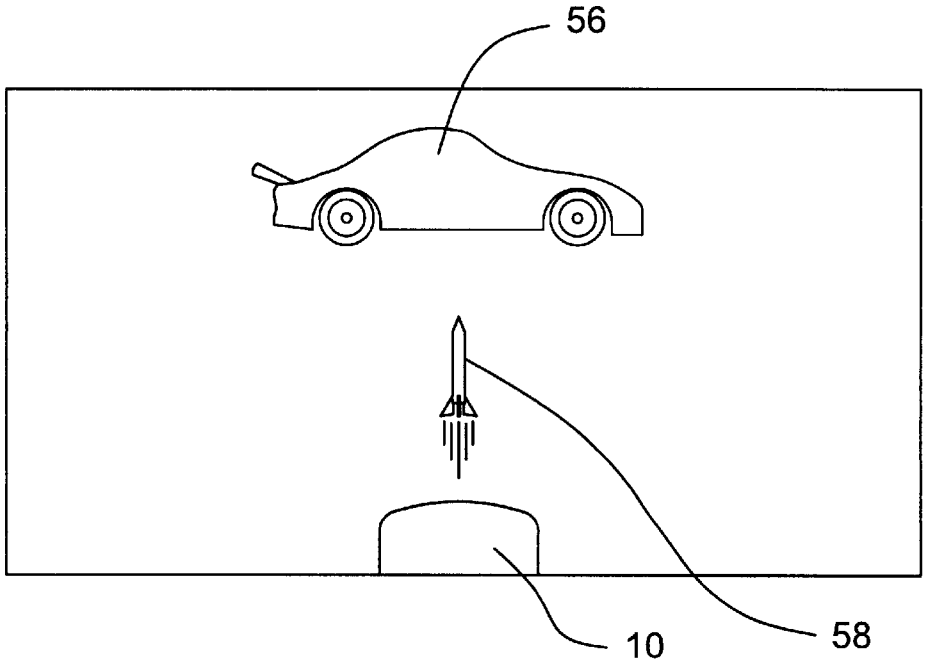
FIG. 10*b* is the same frame after video augmentation.

As still another example, the video from the vehicle 10, shown in FIG. 10*a*, of another vehicle 56 may be enhanced. When the video is viewed on the display 30 the vehicle 10 appears to have fired a rocket 58 at the vehicle 56 as indicated in FIG. 10*b*. In fact, the vehicle 10 may do nothing, as indicated in FIG. 10*a*, but the video obtained from the vehicle 10 may be augmented to include an image 58 of a rocket fired by the vehicle 10. An image may also be generated of the explosive effects, of the type shown in FIG. 8*b*, when the rocket image 58 impacts a pattern recognized object such as the vehicle 56. In some cases, the video enhancement effects may be improved by having an additional video camera, separate and apart from a vehicle 10, for imaging the play surface.

In a number of instances, the controller 28 may be utilized to enhance the control of the toy vehicle 10. The vehicle 10 may be controlled using a joystick or steering wheel (not shown) coupled to the controller 28. In addition, the vehicle 10 may be controlled in a point and click fashion. The user may click on an area of the video display 30 to cause the vehicle 10 to move to that location. A route may be provided to the controller 28 and the vehicle 10 may be caused to automatically follow that route under processor-based system control. A racetrack (not shown) may be set up for example by real cones. The vehicle 10 may then automatically go around the cones in response to processor-based system control which recognizes the cones and their locations. Games may be implemented wherein various track-based vehicles may be directed towards various track positions in order to "run over" or "consume" virtual images that appear to be positioned by the processor-based system on the image of the tracks when viewed on a display.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

receiving video from a toy vehicle;

automatically identifying an image element in said video; and using said image element to automatically control the vehicle.

2. The method of claim 1 including detecting a characteristic of a surface over which said vehicle moves.

3. The method of claim 2 including detecting a color.

4. The method of claim 3 including detecting a pattern on said surface.

5. The method of claim 1 including detecting a visual feature on a second toy vehicle.

6. The method of claim 5 including detecting a target on the second toy vehicle.

7. The method of claim 6 including detecting a color of said target.

8. The method of claim 1 including:

guiding a toy vehicle to more over a surface;

providing an electrical link between the vehicle and the surface;

capturing video from the vehicle; and transmitting said video from the vehicle to the electrical link.

9. The method of claim 8 wherein guiding the toy vehicle includes enabling the toy vehicle to move along the track.

10. The method of claim 9 wherein enabling the vehicle to move along the track includes guiding the vehicle using the track.

11. The method of claim 10 wherein providing the electrical link includes proving an electrical connection between the vehicle and the track and between the track and the control device and transmitting the video from the vehicle to the track to the control device.

12. The method of claim 9 including providing a pair of conductors in said track including a first conductor to provide power and a second conductor to receive video.

13. The method of claim 8 wherein providing electrical link includes providing an electrical contact.

14. The method of claim 8 wherein providing the electrical link includes providing an airwave connection.

15. The method of claim 8 wherein guiding the toy vehicle to move over the surface includes providing an airwave link between an antenna in said surface and an antenna on said vehicle.

16. The method of claim 8 wherein guiding the toy vehicle to move over the surface includes guiding the vehicle by causing the vehicle to follow another vehicle.

17. The method of claim 8 wherein guiding the vehicle includes causing the vehicle to follow an indicia on said surface and capturing video of said indicia to guide said vehicle.

* * * * *